US010144218B2

(12) United States Patent
Takino

(10) Patent No.: US 10,144,218 B2
(45) Date of Patent: Dec. 4, 2018

(54) FLOW PATH MEMBER, LIQUID EJECTING HEAD, AND LIQUID EJECTING APPARATUS

(71) Applicant: SEIKO EPSON CORPORATION, Tokyo (JP)

(72) Inventor: Fumiya Takino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/463,102

(22) Filed: Mar. 20, 2017

(65) Prior Publication Data

US 2017/0274651 A1 Sep. 28, 2017

(30) Foreign Application Priority Data

Mar. 28, 2016 (JP) ..... 2016-063252

(51) Int. Cl.
*B41J 2/14* (2006.01)
*B41J 2/175* (2006.01)

(52) U.S. Cl.
CPC ..... *B41J 2/1433* (2013.01); *B41J 2/14024* (2013.01); *B41J 2/14145* (2013.01); *B41J 2/14201* (2013.01); *B41J 2/17563* (2013.01); *B41J 2002/14362* (2013.01); *B41J 2002/14403* (2013.01); *B41J 2002/14419* (2013.01); *B41J 2002/14491* (2013.01); *B41J 2202/20* (2013.01)

(58) Field of Classification Search
None
See application file for complete search history.

(56) References Cited

U.S. PATENT DOCUMENTS

2006/0221116 A1 10/2006 Miyata
2011/0242239 A1 10/2011 Hara
2013/0187989 A1* 7/2013 Koseki ..... B41J 2/14209 347/71
2013/0201248 A1* 8/2013 Owaki ..... B41J 2/125 347/19

FOREIGN PATENT DOCUMENTS

JP 2001-301199 A 10/2001
JP 2001-322293 A 11/2001
JP 2006-231678 A 9/2006
JP 2007-030379 A 2/2007
JP 2007-050674 A 3/2007
JP 2011-207191 A 10/2011
JP 2015-217658 A 12/2015

* cited by examiner

*Primary Examiner* — Erica Lin
(74) *Attorney, Agent, or Firm* — Workman Nydegger

(57) ABSTRACT

A flow path member includes a plurality of flow paths including a first flow path, a filter chamber which communicates with the first flow path and is provided with a filter, and a second flow path which communicates with the filter chamber, in which the filter is disposed so that a direction including a direction where liquid of the first flow path or the second flow path flows is a surface direction, and in which a plurality of filter chambers are disposed at positions where at least the filter chambers partially overlap each other in a normal direction with respect to the surface direction of the filter.

12 Claims, 11 Drawing Sheets

FLOW PATH MEMBER, LIQUID EJECTING HEAD, AND LIQUID EJECTING APPARATUS

BACKGROUND

1. Technical Field

The present invention relates to a flow path member through which liquid flows, a liquid ejecting head that includes the flow path member, and a liquid ejecting apparatus that includes the liquid ejecting head, and more particularly, to a flow path member through which ink flows as the liquid, an ink jet recording head, and an ink jet recording apparatus.

2. Related Art

A representative example of a liquid ejecting head that ejects liquid is an ink jet recording head that ejects ink droplets. The ink jet recording head provided with a head main body that ejects the ink droplets from a nozzle, and a flow path member that is fixed to the head main body and that supplies the ink from liquid storage means such as an ink cartridge in which the ink is stored to the head main body (for example, refer to JP-A-2011-207191), is proposed.

A filter for trapping air bubbles and foreign matter contained in the ink is disposed in a flow path of such a flow path member.

However, when the ink flows through the flow path of the flow path member, there is a problem that a solvent such as water contained in the ink passes through material of the flow path member and evaporates. Specifically, since a filter chamber provided with the filter has a larger volume than that of the other flow paths, the surface area becomes large, and evaporation of the solvent from the ink is likely to occur.

In addition, in order to suppress the evaporation of the solvent from the filter chamber of the flow path member, when a thickness of the flow path member in the filter chamber is increased, there is a problem that the size of the flow path member is increased.

Such a problem is not limited to the flow path member used in the ink jet recording head, and similarly exists in the flow path member used in the liquid ejecting head that ejects the liquid other than the ink.

In addition, without being limited to the flow path member used in the liquid ejecting head, similar problem exists in the flow path member used in other devices.

SUMMARY

An advantage of some aspects of the invention is to provide a flow path member, a liquid ejecting head, and a liquid ejecting apparatus that can suppress solvent evaporation of liquid and can reduce the size.

According to an aspect of the invention, there is provided a flow path member including a plurality of flow paths that include a first flow path, a filter chamber which communicates with the first flow path and is provided with a filter, and a second flow path which communicates with the filter chamber, in which the filter is disposed so that a direction including a direction where liquid of the first flow path or the second flow path flows is a surface direction, and in which a plurality of filter chambers are disposed at positions where at least the filter chambers partially overlap each other in a normal direction with respect to the surface direction of the filter.

In the aspect, the surface direction of the filter is disposed in a direction including a flow direction of the first flow path or the second flow path, and the plurality of filter chambers are disposed so as to overlap in the normal direction with respect to the surface direction. Therefore, it is possible to simplify an arrangement of the flow path, to increase an effective area of the filter, and to reduce the size in the normal direction with respect to the surface direction of the filter. Furthermore, it is possible to reduce evaporation of the solvent contained in the liquid in the flow path on the side between the stacked filter chambers.

Here, it is preferable that a plurality of filter units provided with the flow path be stacked in the normal direction. According to this, since the flow path member can be configured only by stacking the filter units, it is possible to easily increase or decrease the number of flow paths.

In addition, it is preferable that the filter unit include a filter unit main body provided with a recessed portion, and a lid member that covers the recessed portion and partially forms at least the flow path, and that a plurality of filter unit main bodies be stacked, and one of the stacked filter unit main bodies function as the lid member of the other of the filter unit main bodies. According to this, the lid member is unnecessary between the filter unit main bodies, and it is possible to further reduce the size thereof.

In addition, it is preferable that the plurality of filter units be joined to each other by an adhesive to be stacked. According to this, the filter units are adhered to each other by the adhesive. Therefore, it is possible to suppress the evaporation of the solvent from between the stacked filter units.

In addition, it is preferable that among the filter chambers, liquid with a large influence due to evaporation of a solvent contained in the liquid be supplied to a center side in a stacking direction as compared with both end portion sides. According to this, it is possible to suppress the evaporation of the solvent in the liquid with the large influence due to the evaporation of the solvent, and to suppress the influence due to the evaporation of the solvent in the liquid in the plurality of flow paths.

In addition, it is preferable that the amount of the solvent contained in the liquid supplied to the filter chamber on the center side be smaller than the amount of the solvent contained in the liquid supplied to the filter chamber on both end portion sides. According to this, although when the amount of the solvent contained in the liquid is large, the liquid is less likely to be affected by the evaporation of solvent, when the amount of the solvent contained in the liquid is small, the liquid is likely to be affected by the evaporation of the same amount of solvent. Therefore, the liquid which is likely to be affected by the evaporation of the solvent is supplied to the filter chamber on the center side. Therefore, it is possible to more effectively suppress the influence due to the evaporation of the solvent in the liquid in the plurality of flow paths.

In addition, it is preferable that vapor pressure of the solvent contained in the liquid supplied to the filter chamber on the center side be higher than vapor pressure of the solvent contained in the liquid supplied to the filter chamber on both end portion sides. According to this, when the vapor pressure of the solvent contained in the liquid is high, the liquid is likely to evaporate, and when the vapor pressure of the solvent is low, the liquid is less likely to evaporate. Therefore, liquid containing a solvent which is likely to evaporate is supplied to the filter chamber on the center side. Therefore, it is possible to more effectively suppress the influence due to the evaporation of the solvent in the liquid in the plurality of flow paths.

In addition, it is preferable that among the filter chambers, liquid with the small amount of use per unit time be supplied to a center side in a stacking direction as compared with both end portion sides. According to this, it is possible to suppress the influence due to the evaporation of the solvent of the liquid with the small amount of use.

Furthermore, according to another aspect of the invention, there is provided a liquid ejecting head including the flow path member according to the aspect described above, and a head main body that includes a nozzle which ejects liquid supplied from the flow path member.

In the aspect, it is possible to realize the liquid ejecting head which suppresses the evaporation of the solvent of the liquid and reduces the size thereof.

In addition, according to still another aspect of the invention, there is provided a liquid ejecting apparatus including the liquid ejecting head according to the aspect described above.

In the aspect, it is possible to realize the liquid ejecting apparatus which suppresses the evaporation of the solvent of the liquid and reduces the size thereof.

Furthermore, according to still another aspect of the invention, there is provided a liquid ejecting apparatus including the flow path member according to the aspect described above.

In the aspect, it is possible to realize the liquid ejecting apparatus which suppresses the evaporation of the solvent of the liquid and reduces the size thereof.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on an embodiment.

First Embodiment

Figure 1:
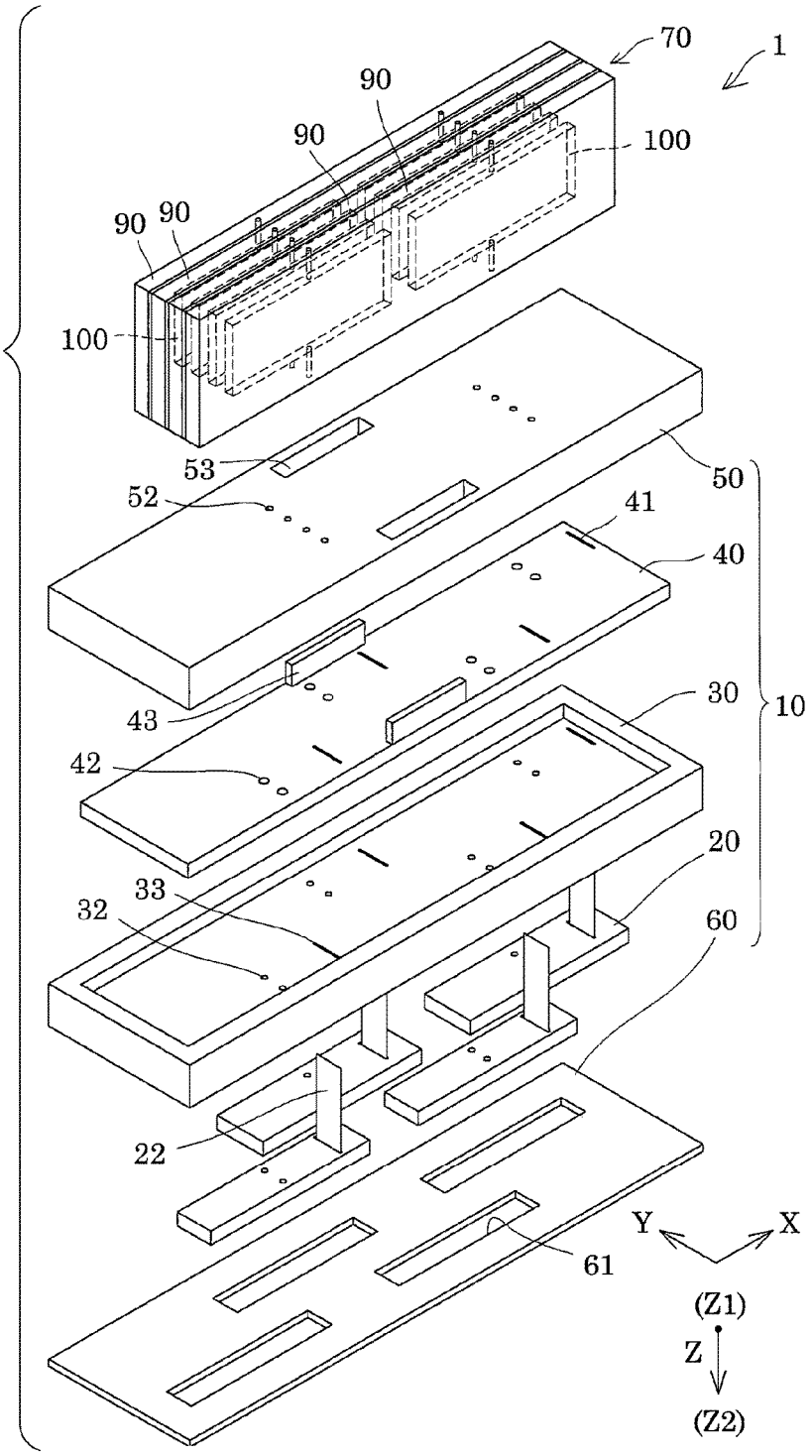
FIG. 1 is an exploded perspective view of a recording head according to a first embodiment of an invention.
Figure 2:
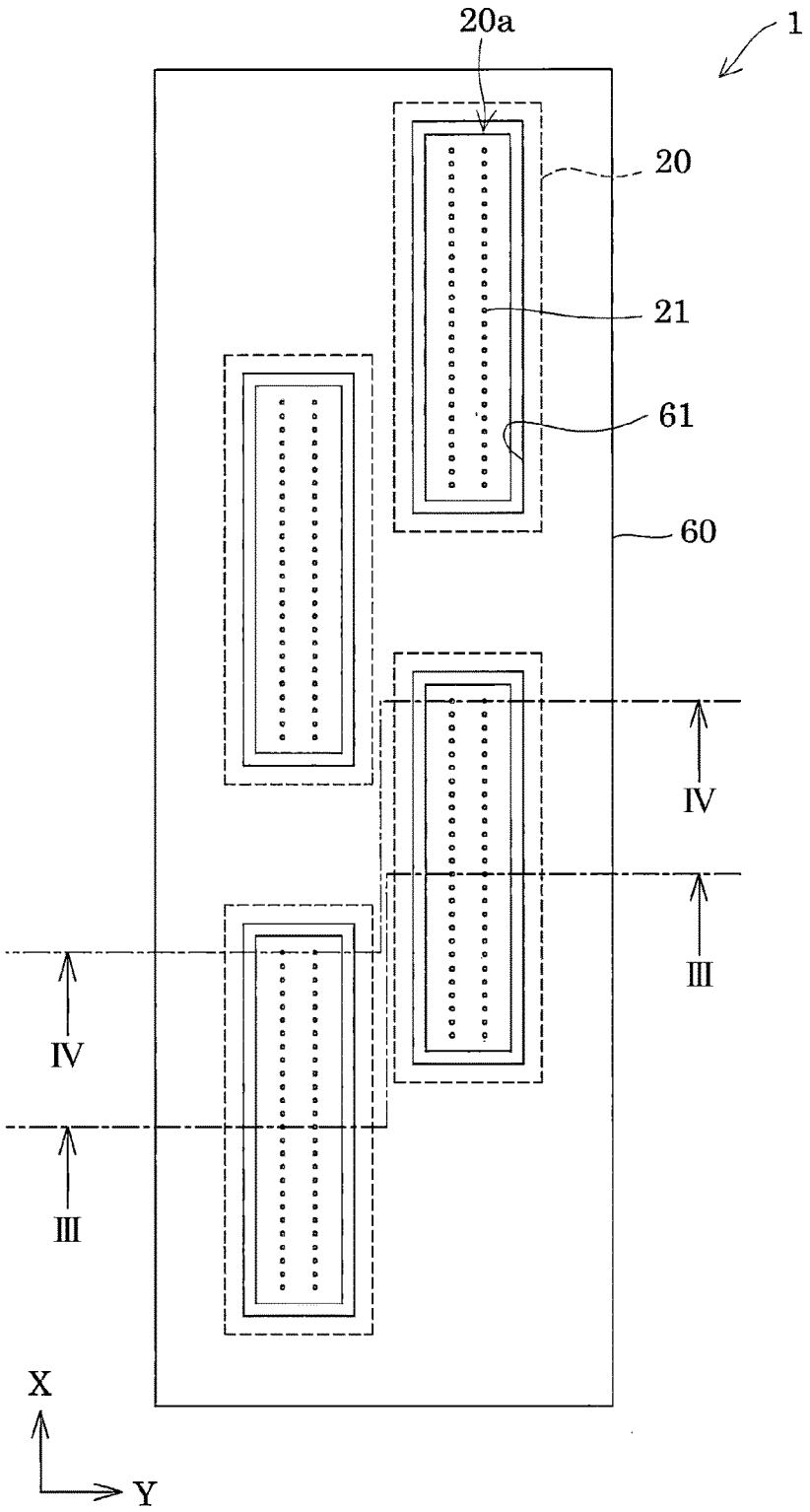
FIG. 2 is a plan view of the recording head according to the first embodiment of the invention.
Figure 3:
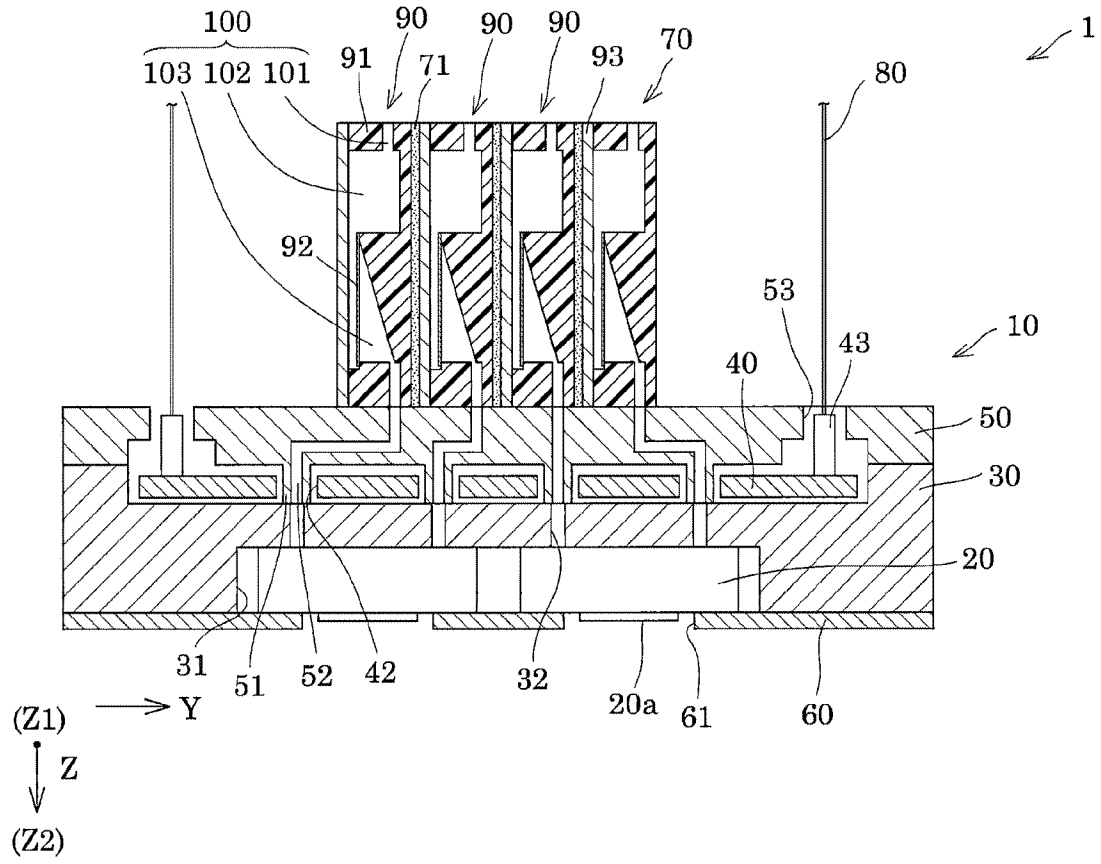
FIG. 3 is a cross-sectional view of the recording head according to the first embodiment of the invention.
Figure 4:
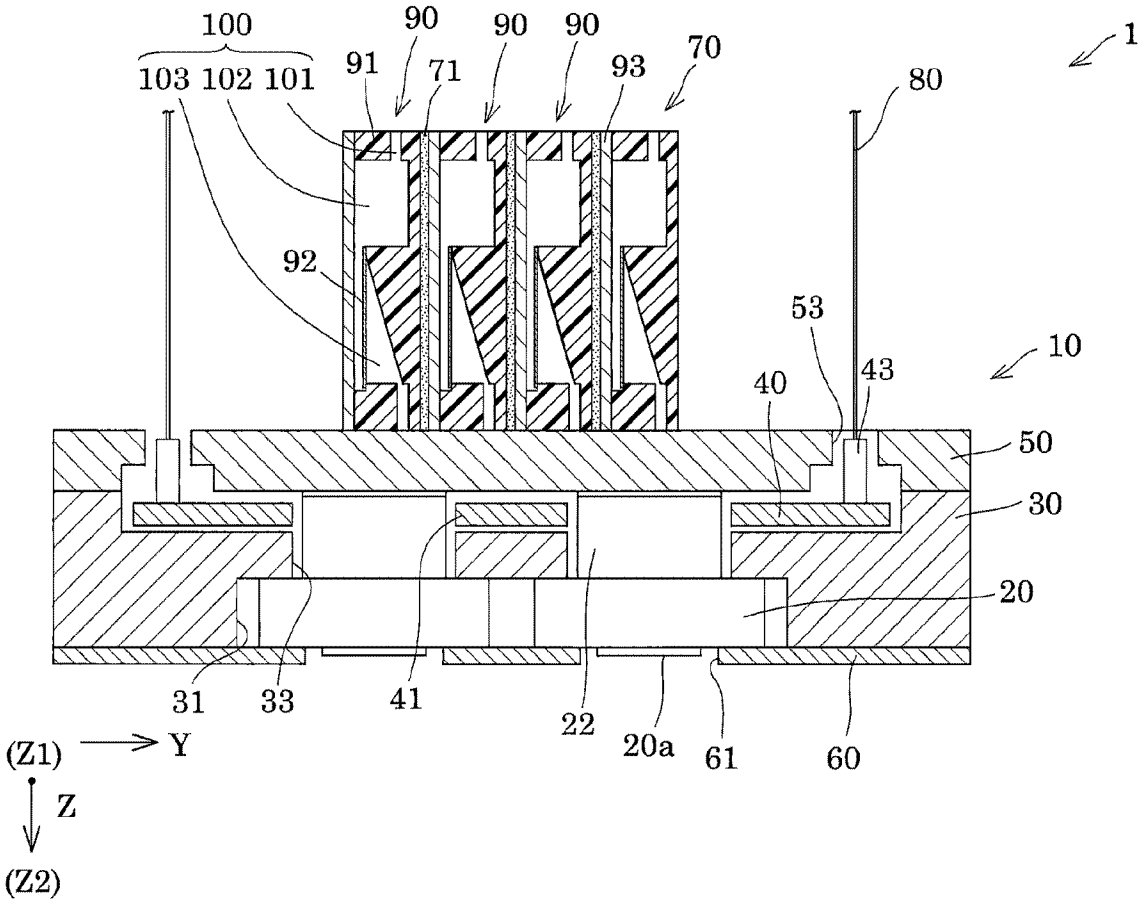
FIG. 4 is a cross-sectional view of the recording head according to the first embodiment of the invention.

FIG. 1 is an exploded perspective view illustrating a schematic configuration of an ink jet recording head which is an example of a liquid ejecting head according to a first embodiment of the invention, FIG. 2 is a plan view of the ink jet recording head, FIG. 3 is a cross-sectional view taken along line III-III of FIG. 2, and FIG. 4 is a cross-sectional view taken along line IV-IV of FIG. 2.

As illustrated, an ink jet recording head 1 (hereinafter, referred to as a recording head 1) which is an example of the liquid ejecting head of the embodiment includes a head main body 10 for ejecting ink as liquid, and a flow path member 70 fixed to the head main body 10.

The head main body 10 includes a plurality of drive units 20 having nozzles for ejecting the ink, a holder 30 holding the plurality of drive units 20, a circuit substrate 40 fixed to the holder 30, a supply member 50, and a fixing plate 60 for fixing the plurality of drive units 20.

In the drive unit 20, the nozzles 21 for ejecting the ink are arranged in parallel. In the embodiment, the direction where the nozzles 21 are arranged in parallel is referred to as a first direction X. In addition, a plurality of rows in which the nozzles 21 are arranged in parallel in the first direction X are disposed in the drive unit 20, and two rows are disposed in the embodiment. A direction in which the plurality of rows of the nozzles 21 are disposed is hereinafter referred to as a second direction Y. Furthermore, a direction intersecting both of the first direction X and the second direction Y is referred to as a third direction Z in this embodiment, the flow path member 70 side is referred to as Z1 side, and the head main body 10 side as Z2 side. In the embodiment, although a relationship between the respective orientations (X, Y, and Z) is orthogonal, the arrangement of each configuration is not necessarily limited to the orthogonal configuration.

A flow path communicating with the nozzle 21 and pressure generating means for causing a pressure change in the ink in the flow path are disposed inside (not illustrated) of such a drive unit 20. As the pressure generating means, for example, means for changing the volume of the flow path by deformation of a piezoelectric actuator having a piezoelectric material exhibiting an electromechanical conversion function to cause a pressure change in the ink in the flow path and ejecting ink droplets from the nozzle 21, means for disposing a heating element in the flow path and ejecting the ink droplets from the nozzle 21 by bubbles generated by heat generation of the heating element, and a so-called electrostatic actuator for generating an electrostatic force between a diaphragm and an electrode to deform the diaphragm by the electrostatic force and ejecting the ink droplets from the nozzle 21 can be used. In addition, from the surface on the side opposite to the third direction Z from surfaces on which the nozzles 21 of each drive units 20 are open, a drive wiring 22 connected to internal pressure generating means (not illustrated) is led out. The surface on which the nozzle 21 of the drive unit 20 is open is a nozzle surface 20*a*.

An accommodation portion 31 for accommodating a plurality of drive units 20 on one surface side in the third direction Z is disposed in the holder 30. The accommodation portion 31 has a recessed shape opening to one side in the third direction Z and accommodates the plurality of drive units 20 fixed by the fixing plate 60. An opening of the accommodating portion 31 is sealed by the fixing plate 60. That is, the drive unit 20 is accommodated inside a space formed by the accommodation portion 31 and the fixing plate 60. The accommodation portion 31 may be disposed for each drive unit 20 or may be continuously disposed over the plurality of drive units 20.

In such a holder 30, the drive units 20 are disposed in a zigzag shape along the first direction X. Here, a description means that disposing the drive units 20 in the zigzag shape along the first direction X is disposing the drive units 20 arranged in parallel in the first direction X to be alternately shifted in the second direction Y. That is, two rows of drive units 20 arranged in parallel in the first direction X are arranged in parallel in the second direction Y, and two rows of drive units 20 are arranged to be shifted by a half pitch in the first direction X. The drive units 20 are arranged in the zigzag shape along the first direction X in this manner. Therefore, the two nozzles 21 of the drive units 20 are partially overlapped in the first direction X and continuous rows of nozzles 21 can be formed over the first direction X.

In addition, as illustrated in FIG. 3, the communication flow path 32 for supplying the ink supplied from the supply member 50 to the drive unit 20 is disposed in the holder 30. Two communication flow paths 32 are disposed for one drive unit 20. That is, the communication flow path 32 is disposed to correspond to each row of the nozzles 21 disposed in one drive unit 20.

Furthermore, as illustrated in FIG. 4, a wiring insertion hole 33 for inserting the drive wiring 22 of the drive unit 20 is disposed in the holder 30. The drive wiring 22 of the drive unit 20 disposed on a Z2 side is led to a Z1 side of the holder 30 by inserting the wiring insertion hole 33 of the holder 30.

The circuit substrate 40 is held in the Z1 side of the holder 30. The circuit substrate 40 is made of a rigid substrate provided with electronic component, wiring, and the like. As illustrated in FIG. 4, the circuit substrate 40 has a drive wiring connection hole 41 penetrating in the third direction Z which is a thickness direction, and the drive wiring 22 inserted through the drive wiring connection hole 41 from the Z2 side surface is electrically connected to the circuit substrate 40 on the Z1 side surface of the circuit substrate 40.

In addition, as illustrated in FIG. 3, the circuit substrate 40 is provided with an insertion hole 42 into which a projection portion 51 provided so as to project from the Z2 side of the supply member 50 is inserted, corresponding to the communication flow path 32 of the holder 30.

Furthermore, connectors 43 to which external wirings 80 are respectively connected on both sides in the second direction Y are disposed on the Z1 side surface of the circuit substrate 40. A connection port to which the external wiring 80 of the connector 43 is connected is open to the Z1 side, and the external wiring 80 is connected to the connector 43 from the Z1 side.

As illustrated in FIG. 3, the supply member 50 is fixed to the Z1 side of the holder 30. In addition, the supply member 50 is provided with a supply flow path 52 for supplying the ink to the communication flow path 32 of the holder 30. The supply flow path 52 is disposed so as to open to the Z1 side surface and the Z2 side surface of the supply member 50. The supply flow path 52 may have a flow path extending in a direction intersecting the third direction Z according to the position of the flow path of the flow path member 70 and the communication flow path 32 of the holder 30.

In addition, the supply member 50 is provided with a through hole 53 penetrating in the third direction Z at a position corresponding to the connector 43. The external wiring 80 inserted into the through hole 53 from the Z1 side of the supply member 50 is connected to the connector 43 of the circuit substrate 40.

In addition, the fixing plate 60 that closes the opening of the accommodation portion 31 of the holder 30 is provided with an exposure opening portion 61 that exposes the nozzle surface 20*a* of each of the drive units 20. In the embodiment, the exposure opening portion 61 is independently disposed for each drive unit 20, and a space between the adjacent drive units 20 is sealed by the fixing plate 60. The fixing plate 60 is fixed to the nozzle surface 20*a* side of the drive unit 20 at a peripheral edge portion of the exposure opening portion 61.

The ink is supplied from the flow path member 70 to the drive unit 20 via the supply flow path 52 and the communication flow path 32 and the pressure generation means in the drive unit 20 is driven based on the drive signal. Therefore, such a head main body 10 ejects the ink droplets from the nozzle 21.

In addition, the flow path member 70 for supplying the ink to the head main body 10 is fixed to the Z1 side surface of the supply member 50. The flow path member 70 of the embodiment is configured by stacking a plurality of filter units 90 in the second direction Y.

Figure 5:
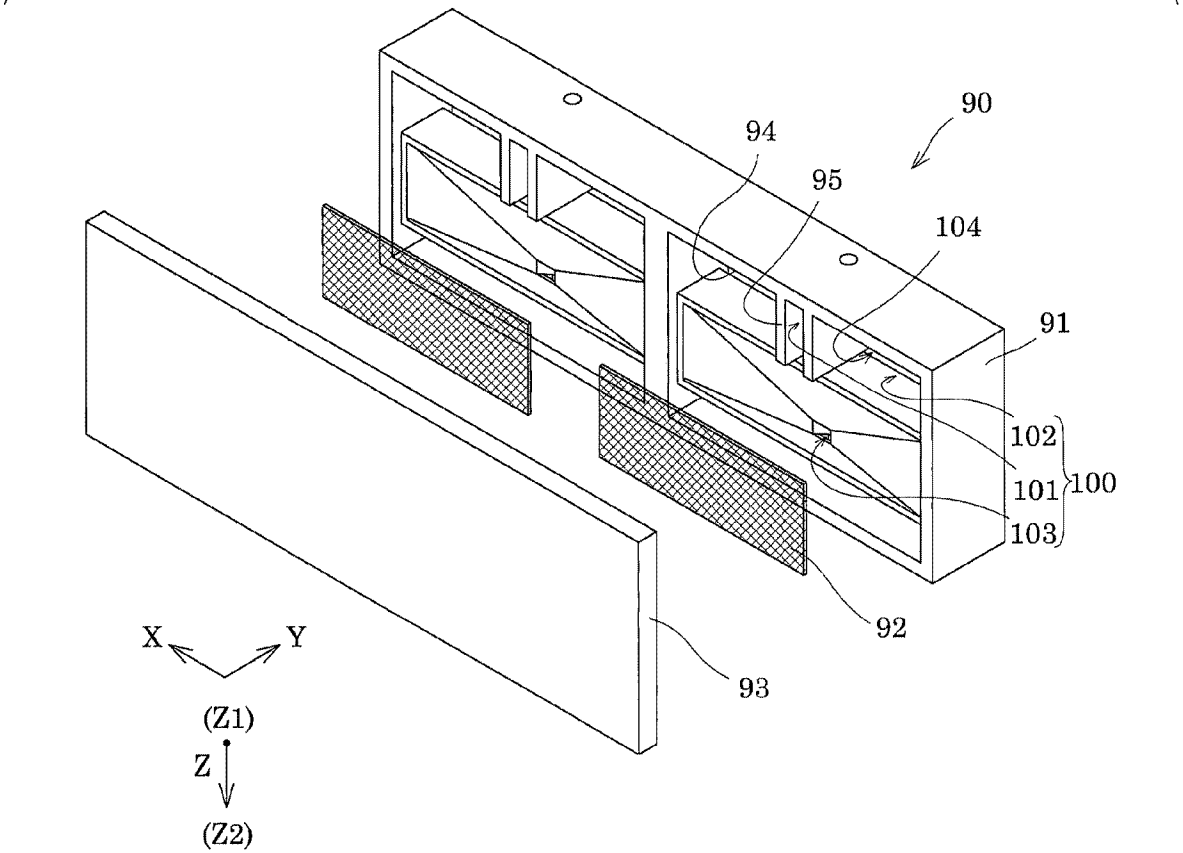
FIG. 5 is an exploded perspective view of a filter unit according to the first embodiment of the invention.
Figure 6:
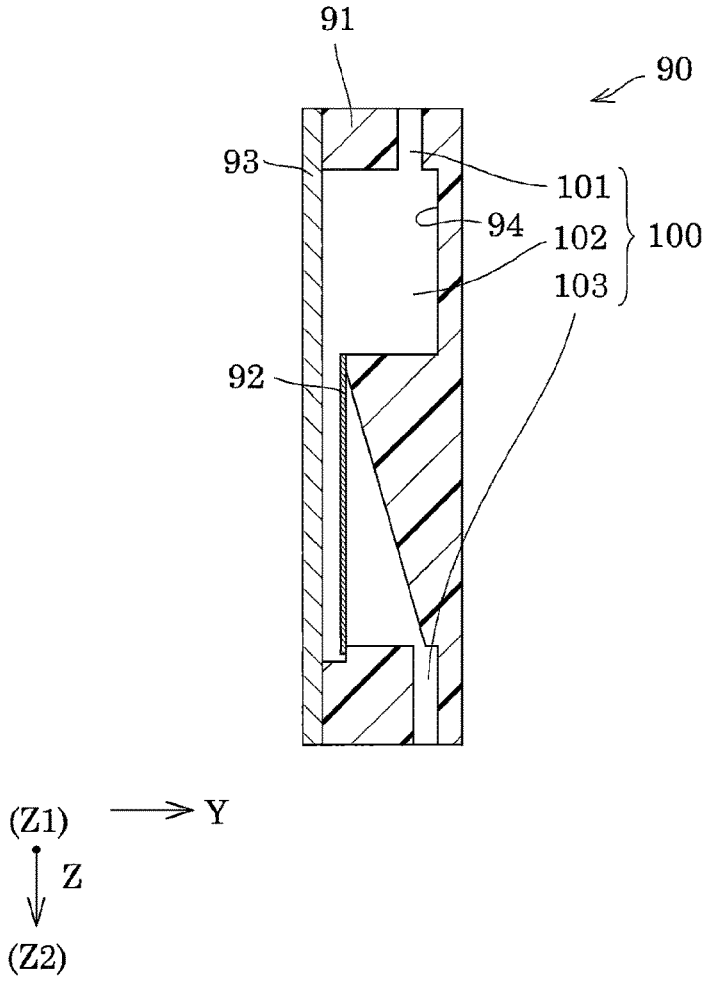
FIG. 6 is a cross-sectional view of the filter unit according to the first embodiment of the invention.

Here, the filter unit 90 of the embodiment that constitutes the flow path member 70 will be further described with reference to FIGS. 5 and 6. FIG. 5 is an exploded perspective view illustrating a schematic configuration of the filter unit, and FIG. 6 is a cross-sectional view of the filter unit. In addition, in the embodiment, each direction of the filter unit 90 will be described based on directions when the filter unit 90 is fixed to the head main body 10, that is, the first direction X, the second direction Y, and the third direction Z. As a matter of course, the direction of the flow path member 70 to the head main body 10 is not limited to the following.

As illustrated in FIGS. 5 and 6, the filter unit 90 of the embodiment includes a filter unit main body 91, a filter 92 disposed in the filter unit main body 91, and a lid member 93.

In addition, the filter unit 90 is a unit for supplying the ink to the head main body from liquid storage means in which the ink is stored, and a flow path 100 is disposed inside the filter unit 90.

The flow path 100 includes a first flow path 101 opening to the Z1 side of the filter unit 90, a filter chamber 102 communicating with the first flow path 101, and a second flow path 103 communicating with the filter chamber 102 and opening to the Z2 side.

The first flow path 101 and the filter chamber 102 are formed by sealing an opening of a recessed portion 94 opening on one side in the first direction X of the filter unit main body 91 with the lid member 93.

In addition, the second flow path 103 is disposed by one end thereof opens to the filter chamber 102 and the other end thereof is opened on the Z2 side surface of the filter unit main body 91.

The first flow path 101 and the second flow path 103 as described above are formed along the third direction Z in the embodiment. The first flow path 101 and the second flow path 103 may be formed along a direction intersecting the second direction Y which is a stacking direction of the filter unit 90, that is, along a direction including the first direction X and the third direction Z. That is, the first flow path 101 and the second flow path 103 may be disposed by being bent in the first direction X.

Additionally, the direction along which the first flow path 101 and the second flow path 103 are formed is the direction in which the ink flows inside the first flow path 101 and the second flow path 103. In addition, the description that the first flow path 101 and the second flow path 103 are formed along the direction including the first direction X and the third direction Z means that half or more of each of the flow path lengths of the first flow path 101 and the second flow path 103 are formed along the direction including the first direction X and the third direction Z. That is, the half or more of each of the flow path lengths of the first flow path 101 and the second flow path 103 may be formed along the direction including the first direction X and the third direction Z which are surface directions of the filter 92. The flow path in which the other portion of the flow path lengths of the first flow path 101 and the second flow path 103 is formed along the direction including the second direction Y is included.

In addition, the filter 92 is disposed so that the first direction X and the third direction Z are the surface direction in the filter chamber 102. The first flow path 101 communicates with one of the lid member 93 side partitioned by the filter 92 of the filter chamber 102 and the second flow path 103 communicates with the other of the side opposite to the lid member 93. Thereby, the ink supplied from the first flow path 101 to the filter chamber 102 passes through the filter 92 and is supplied from the second flow path 103 to the head main body 10.

As illustrated in FIG. 5, the first flow path 101 is partitioned from the filter chamber 102 by the two wall portions 95 and an outside of the wall portion 95 in the filter chamber 102, that is, the space on the Z1 side of the filter chamber 102 is a bubble chamber 104. The bubble chamber 104 is a space where bubbles trapped by the filter 92 are reserved by buoyant force.

In the embodiment as described above, the filter 92 is disposed so that the surface direction thereof is a direction including the flow directions of the first flow path 101 and the second flow path 103, that is, a direction including the first direction X and the third direction Z. Therefore, the filter unit 90 can increase an effective area of the filter 92 while reducing the thickness in the second direction Y. Additionally, in a case where the surface direction of the filter 92 is disposed in a direction including the first direction X and the second direction Y, in order to increase the effective area of the filter 92, the size of the filter unit 90 is increased in any one or both of the first direction X and the second direction Y. In the embodiment, the filter 92 is disposed so that the surface direction thereof is a direction including the flow directions of the first flow path 101 and the second flow path 103. Therefore, the effective area of the filter 92 is increased and it is possible to suppress the size of the filter unit 90 from being increased in any one or both of the first direction X and the second direction Y. Therefore, even when the plurality of filter units 90 are stacked in the second direction Y, arrangement of the flow path 100 is facilitated, the reduction of the effective area of the filter 92 is suppressed, and it is possible to reduce the size of the flow path member 70.

In such a filter unit 90, two flow paths 100 are arranged in parallel in the first direction X. In the embodiment, although two flow paths 100 are disposed in one filter unit 90, the filter unit 90 is not particularly limited thereto. One flow path 100 may be disposed, or three or more flow paths 100 may be disposed in one filter unit 90.

The plurality of filter units 90, four in the embodiment, are stacked in the second direction Y to constitute the flow path member 70 in the embodiment. Thereby, the flow path member 70 has the same number as the number of rows of the nozzles 21, that is, a total of eight flow paths 100.

Here, in the plurality of filter units 90 constituting the flow path member 70, the filter unit main body 91 of one filter unit 90 and the lid member 93 of the other filter unit 90 are bonded by an adhesive 71. That is, the flow path member 70 is configured by stacking the filter unit main body 91 and the lid member 93 alternately and repeatedly. The plurality of filter chambers 102 disposed in the plurality of filter units 90 are disposed so as to at least partially overlap each other in the second direction Y which is a normal direction with respect to the surface direction of the filter 92. That is, the filter unit 90 having the same shape is stacked in the second direction Y in the embodiment. Therefore, the plurality of filter chambers 102 are disposed so as to at least partially overlap each other in the second direction Y which is the normal direction to the direction including the first direction X which is the surface direction of the filter 92 and the third direction Z. Additionally, the description means that overlapping the plurality of filter chambers 102 at least partially each other in the second direction Y is overlapping the filter chambers 102 at least partially each other, in a plan view from the second direction Y. That is, the filter chamber 102 includes case in which all thereof overlap each other or case in which only a portion thereof overlap each other. As a matter of course, the filter chambers 102 to be stacked may have different areas, and one of the filter chamber 102 may overlap so as to be included in the other filter chambers 102. The plurality of filter chambers 102 are disposed in a position at least partially overlapping each other in the second direction Y in this manner. Therefore, it is possible to suppress the size of the flow path member 70 from being increased in the surface direction of the filter 92.

Figure 7:
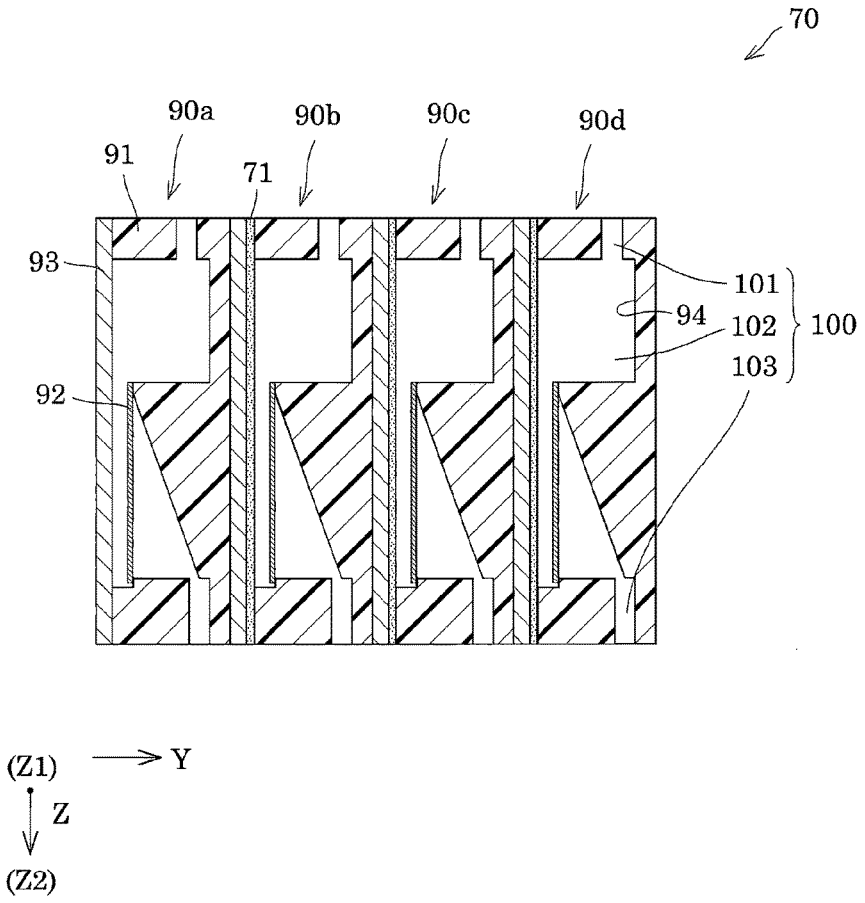
FIG. 7 is a cross-sectional view of a flow path member according to the first embodiment of the invention.

Here, as illustrated in FIG. 7, when the filter units 90 constituting the flow path member 70 of the embodiment are referred to as 90*a*, 90*b*, 90*c* and 90*d* in order in the second direction Y, the ink in the flow path 100 disposed in the two filter units 90*b* and 90*c* disposed on the center side in the second direction Y which is the stacking direction is difficult to evaporate as compared with that in the filter units 90*a* and 90*d* disposed on both end portion sides in the second direction Y. For example, in the flow path 100 of the filter unit 90*b*, on one side in the second direction Y, the lid member 93 and the filter unit main body 91 of the filter unit 90*a* and the lid member 93 of the filter unit 90*b* are interposed with respect to an external environment such as outside air. In addition, in the flow path 100 of the filter unit 90*b*, on the other side in the second direction Y, the filter unit main body 91 of the filter unit 90*b*, the lid member 93 and the filter unit main body 91 of the filter unit 90*c*, and the lid member 93 and the filter unit main body 91 of the filter unit 90*d* are interposed with respect to the external environment. Therefore, the ink in the flow path 100 of the filter unit 90*b* is difficult to evaporate the solvent such as water contained in the ink as compared with the flow paths 100 in the filter units 90*a* and 90*d*. Specifically, in the embodiment, since the filter chamber 102 is formed with the largest surface area in the side of the second direction Y, among the first flow path 101, the filter chamber 102, and the second flow path 103, both sides of the filter chamber 102 in the second direction Y are covered with another filter unit 90. Therefore, evaporation of the solvent contained in the ink from the filter chamber 102 formed with a particularly large area in the flow path 100 of the filter unit 90*b* can be suppressed.

Additionally, on one side in the second direction Y, the flow path 100 of the filter unit 90*a* is interposed with only the lid member 93 of the filter unit 90*a* with respect to the external environment such as the outside air. Therefore, in the flow path 100 of the filter unit 90*a*, the solvent contained in the ink permeates the material of the lid member 93 from one side in the second direction Y, and the evaporation is likely to occur.

The evaporation of the solvent contained in the ink in the flow path 100 occurs by permeation of the solvent contained in the ink in the materials of the filter unit main body 91 and the lid member 93. Although it is conceivable to form the member constituting the filter unit 90 of a material having a low permeability (water vapor permeability) of the solvent, it is required to form the flow path 100 having a complicated shape, and it is required to reduce the cost in the filter unit 90. Therefore, the filter unit 90 cannot be formed of a material with low permeability of the solvent in some cases. In the embodiment, since the evaporation of the solvent contained in the ink in the flow path 100 disposed in the filter units 90*b* and 90*c* can be suppressed, the member constituting the filter unit 90 can be formed at low cost by molding a material having a relatively high permeability (water vapor permeability) of the solvent, for example, a resin material.

In addition, in the flow path member 70, since the evaporation of the solvent such as water contained in the ink in the flow paths 100 of the filter units 90*b* and 90*c* can be suppressed, the thickness of the filter unit main body 91 and the lid member 93 of the filter units 90*b* and 90*c*, that is, the thickness of the member interposed between the flow path 100 and the outside can be relatively reduced. Therefore, it is possible to reduce the size of the flow path member 70 in the second direction Y which is the stacking direction in which the filter units 90 are stacked. In the embodiment, as described above, the stacking direction of the filter unit 90 constituting the flow path member 70 is the second direction Y which is the normal direction to the surface of the filter 92. Therefore, without reducing the effective area of the filter 92, it is possible to reduce the size of the flow path member 70 in the second direction Y.

Furthermore, in the flow path member 70 of the embodiment, since the evaporation of the solvent such as water contained in the ink on the center side in the stacking direction, that is, in the flow path 100 of the filter units 90*b* and 90*c* of the filter chamber 102 can be suppressed, for example, it is preferable that the filter units 90*b* and 90*c* circulate the ink having a large influence due to the evaporation of the solvent and the filter units 90*a* and 90*d* circulate the ink having a small influence due to the evaporation of the solvent. The ink (liquid) having a large influence due to the evaporation of the solvent is the ink (liquid) in which the solvent is likely to evaporate. Additionally, an easiness of the evaporation of the solvent contained in the ink refers to the evaporation amount of the solvent per unit time of the ink in the same environment. That is, among the filter chambers 102, it is preferable to supply the ink which is likely to cause the evaporation of the solvent per unit time on the center side in the stacking direction, that is, in the flow paths 100 of the filter units 90*b* and 90*c*, and to supply the ink which is difficult to cause the evaporation of the solvent per unit time in the filter units 90*a* and 90*d*. The ink which is likely to cause the evaporation of the solvent per unit time is supplied in the flow paths 100 of the filter units 90*b* and 90*c*, and the ink which is difficult to cause the evaporation of the solvent per unit time is supplied in the filter units 90*a* and 90*d* in this manner. Therefore, the evaporation of the solvent contained in the ink in each flow path 100 is reduced as much as possible and wasteful consumption of thickened ink and cleaning time can be reduced.

Additionally, when the solvent of the ink evaporates and the viscosity of the ink increases, the weight of the ejected ink droplets decreases, and saturation and color are affected. In addition, when the viscosity of the ink increases, a landing position is shifted, and shift in overlapping of colors and shift in rule marks occur. Therefore, it is required to discard the ink thickened by the evaporation of the solvent by cleaning, wasteful consumption of the ink increases, and cleaning time is frequently required.

The magnitude of the influence due to the evaporation of the solvent contained in the ink includes, for example, a difference in the content of the solvent such as water contained in the ink. That is, in a case where the same solvent is contained in different inks, when the content of the solvent of the ink is large, the ink is less likely to be affected by the evaporation of solvent, but when the content of the solvent of the ink is small, the influence is increased by the evaporation of the same amount of solvent. Therefore, the ink having a small content of a solvent which is likely to be affected by the evaporation of the solvent is supplied to the flow path 100*s* of the filter units 90*b* and 90*c* on the center side. Therefore, the influence due to the evaporation of the solvent of the ink in the flow paths 100 of all the filter units 90*a*, 90*b*, 90*c*, and 90*d* can be suppressed.

In addition, the magnitude of the influence due to the evaporation of the solvent contained in the ink includes, for example, a difference in the vapor pressure of the solvent contained in the ink. That is, when the vapor pressure of the solvent contained in the ink is high, it is likely to evaporate, and when the vapor pressure of the solvent is low, it is less likely to evaporate. Therefore, the ink containing a solvent which is likely to evaporate is supplied to the flow path 100 of the filter units 90*b* and 90*c* on the center side. Therefore, the influence due to the evaporation of the solvent of the ink in the flow paths 100 of all the filter units 90*a*, 90*b*, 90*c*, and 90*d* can be suppressed. In the embodiment, hereinafter, it will be described that the ink containing the solvent such as the same water is set to be supplied in each of the flow paths 100 of the filter units 90*a*, 90*b*, 90*c*, and 90*d*.

In addition, among the filter chamber 102, it is preferable that the ink with a small amount of use per unit time be supplied on the center side in the stacking direction, that is, in the flow paths 100 of the filter units 90*b* and 90*c* as compared with on both end portion sides in the flow paths 100 of the filter units 90*a* and 90*d*. In a case where the amount of ink used per unit time is small, the time that the ink stays in the filter chamber 102 is increased, and the influence due to the evaporation of the solvent such as water contained in the ink held in the filter chamber 102 is increased. On the other hand, when the amount of ink used per unit time is large, since the time that the ink stays in the filter chamber 102 is reduced, and new ink is constantly supplied into the filter chamber 102, even if the solvent contained in the ink in the filter chamber 102 evaporates to a large extent, the influence on the ink held in the filter chamber 102 is small. Therefore, the ink having a small amount of use per unit time is adapted to be supplied in the flow path 100 of each of the filter units 90*b* and 90*c* as compared with on both end portion sides in the flow path 100 of the filter units 90*a* and 90*d*. Therefore, the influence due to the evaporation of the solvent to the ink can be reduced. For example, the ink having a large amount of use per unit time includes black (K) ink. Therefore, black ink is supplied to the flow paths 100 of the filter units 90*a* and 90*d*, and any one ink except for black (K), for example, cyan (C), magenta (M), and yellow (Y) may be supplied to the flow paths of the filter units 90*b* and 90*c*.

In the embodiment, since the plurality of filter units 90 are constituted with the same members, it is possible to reduce the kinds of components and to reduce the cost. However, for example, it is preferable that the thickness of the lid member 93, that is, the lid member 93 of the filter unit 90*a* disposed on the outermost side be increased than that of the lid member 93 of each of the other filter units 90*b*, 90*c*, and 90*d*, of the filter unit 90. Thereby, the thickness of the lid member 93 of the flow path 100 of the filter unit 90*a* which is closest to the outside air is increased, and thus the evaporation of the solvent of the ink in the flow path 100 of the filter unit 90*a* can be suppressed. In this manner, instead of increasing the thickness of the lid members 93 of all the filter units 90, only the lid member 93 of the filter unit 90*a* is more increased than the lid members 93 of the other filter units 90*b*, 90*c*, and 90*d*. Therefore, it is possible to suppress the size of the flow path member 70 from being increased in the second direction Y.

In addition, in the embodiment, since the plurality of filter units 90 are constituted with the same members, it is possible to use the filter unit 90 for general purpose. That is, in the embodiment, although the flow path member 70 is formed by stacking four filter units 90 in the second direction Y, the number of the filter units 90 constituting the flow path member 70 is not particularly limited to this, but the number thereof may be five or more, or may be three or less. Since the filter unit 90 is constituted with the same members, it is possible to easily change the number of filter units 90 constituting the flow path member 70 according to the head main body 10.

In addition, since the size of the flow path member 70 can be reduced in the second direction Y, it is possible to dispose the through hole 53 connecting the external wiring 80 and the connector 43 in the supply member 50 so as to open to the Z1 side surface. Specifically, it is possible to dispose the through hole 53 on both sides of the flow path member 70 in the second direction Y. Therefore, it is possible to connect the external wiring 80 inserted into the through hole 53 from the Z1 side of the supply member 50 to the connector 43 of the circuit substrate 40. Therefore, the external wiring 80 is connected to the connector 43 on the side opposite to the nozzle surface 20*a*. Therefore, it is possible to suppress the intrusion of the ink into the through hole 53. On the other hand, in a case where the flow path member 70 is large and the occupied area of the flow path member 70 on the Z1 side of the supply member 50 is large, the area where the through hole 53 for opening the connector 43 is disposed decreases. Therefore, for example, when the connection between the external wiring 80 and the connector 43 is performed on the side surface of the holder 30, that is, on both sides in the first direction X, or on both sides in the second direction Y, the ink is likely to intrude into the inside from the side surface.

Second Embodiment

Figure 8:
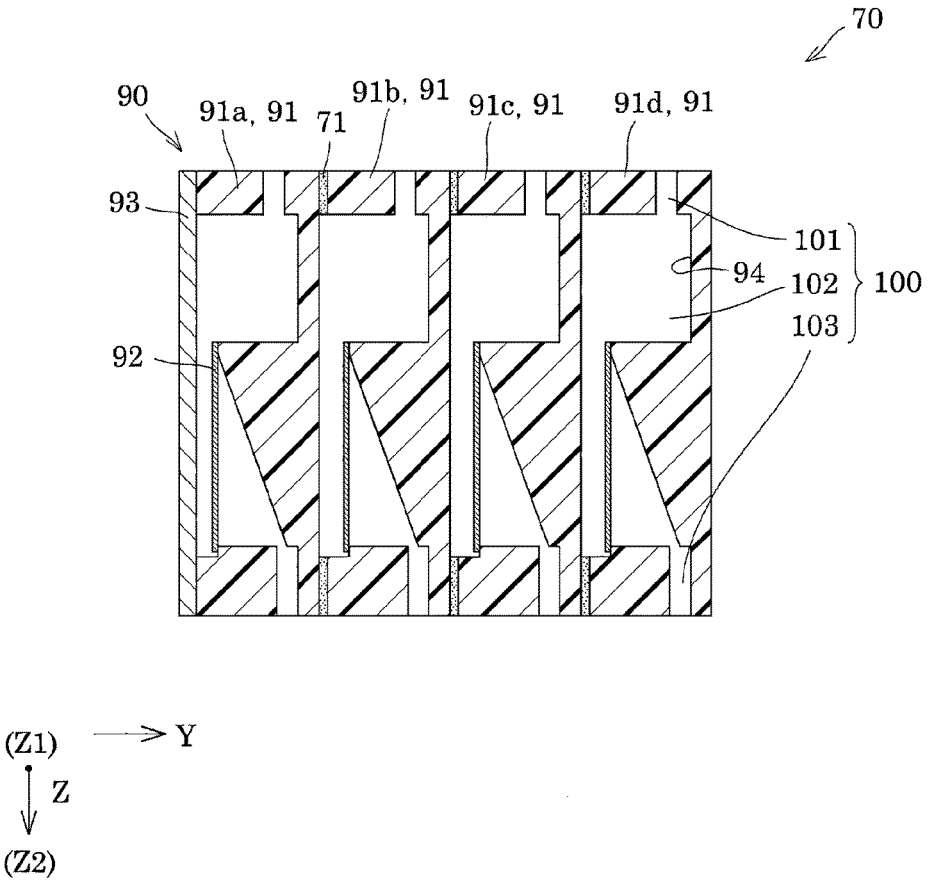
FIG. 8 is a cross-sectional view of a flow path member according to a second embodiment of the invention.

FIG. 8 is a cross-sectional view of a flow path member according to a second embodiment of the invention. The same reference numerals are given to the same members as those in the first embodiment described above, and redundant descriptions will be omitted.

As illustrated in FIG. 8, the flow path member 70 of the embodiment includes the plurality of filter unit main bodies 91, four in this embodiment, stacked in the second direction Y, filters 92 fixed to each of the filter unit main bodies 91, and one lid member 93.

Specifically, one filter unit main body 91 functions as a lid member with respect to the other filter unit main body 91. That is, when the filter unit main bodies 91 arranged in parallel in the second direction Y are referred to as the filter unit main bodies 91*a*, 91*b*, 91*c* and 91*d* in order, an opening of the recessed portion 94 of the filter unit main body 91*d* is sealed by the filter unit main body 91*c* adhered by the adhesive 71. Similarly, an opening of the recessed portion 94 of the filter unit main body 91*c* is sealed by the filter unit main body 91*b* and an opening of the recessed portion 94 of the filter unit main body 91*b* is sealed by the filter unit main body 91*a*. The opening of the recessed portion 94 of the filter unit main body 91*a* is sealed by the lid member 93. In other words, in the filter unit 90 adjacent to each other in the stacking direction, the lid member 93 of one filter unit 90 and the filter unit main body 91 of the other filter unit 90 are integrated.

Even with such a configuration, it is possible to reduce the evaporation of the solvent of the ink in the flow path 100 on the center side in the second direction Y which is the stacking direction, that is, in the flow paths 100 disposed in the filter unit main bodies 91*b* and 91*c* as compared with the evaporation of the solvent of the ink in the flow paths 100 of the filter unit main bodies 91*a* and 91*d* which is the both end portion sides. In addition, the lid member 93 between the stacked filter unit main bodies 91 illustrated in the first embodiment is removed. Therefore, it is possible to reduce the size of the flow path member 70 in the second direction Y by three lid members 93 as compared with the first embodiment.

In the embodiment similar to the first embodiment, the thickness of the lid member 93 for sealing the opening of the filter unit main body 91*a* is increased. Therefore, it is possible to suppress the evaporation of the ink in the flow path 100 disposed in the filter unit main body 91*a* on the lid member 93 side.

In addition, in the embodiment, the same members are used as the stacked filter unit main body 91 constituting the flow path member 70. Therefore, the filter unit main body 91 is generalized, and thus it is possible to easily change the stacking number of the filter unit main body 91 according to the head main body 10.

Other Embodiment

Although each embodiment of the invention is described, the basic configuration of the invention is not limited to the configuration described above.

For example, in the first and second embodiments described above, although in the flow path member 70, the filter unit 90 or the filter unit main body 91 is stacked in the second direction Y with respect to the head main body 10, without being particularly limited thereto, the filter unit 90 or the filter unit main body 91 may be stacked in the first direction X with respect to the head main body 10, and the filter unit 90 or the filter unit main body 91 may be stacked in a direction intersecting both the first direction X and the second direction Y.

In addition, in the first and second embodiments described above, although members having the same shape are used as the filter unit main body 91 constituting the flow path member 70, the embodiments are not particularly limited thereto. Here, another example of the filter unit main body is illustrated in FIG. 9.

Figure 9:
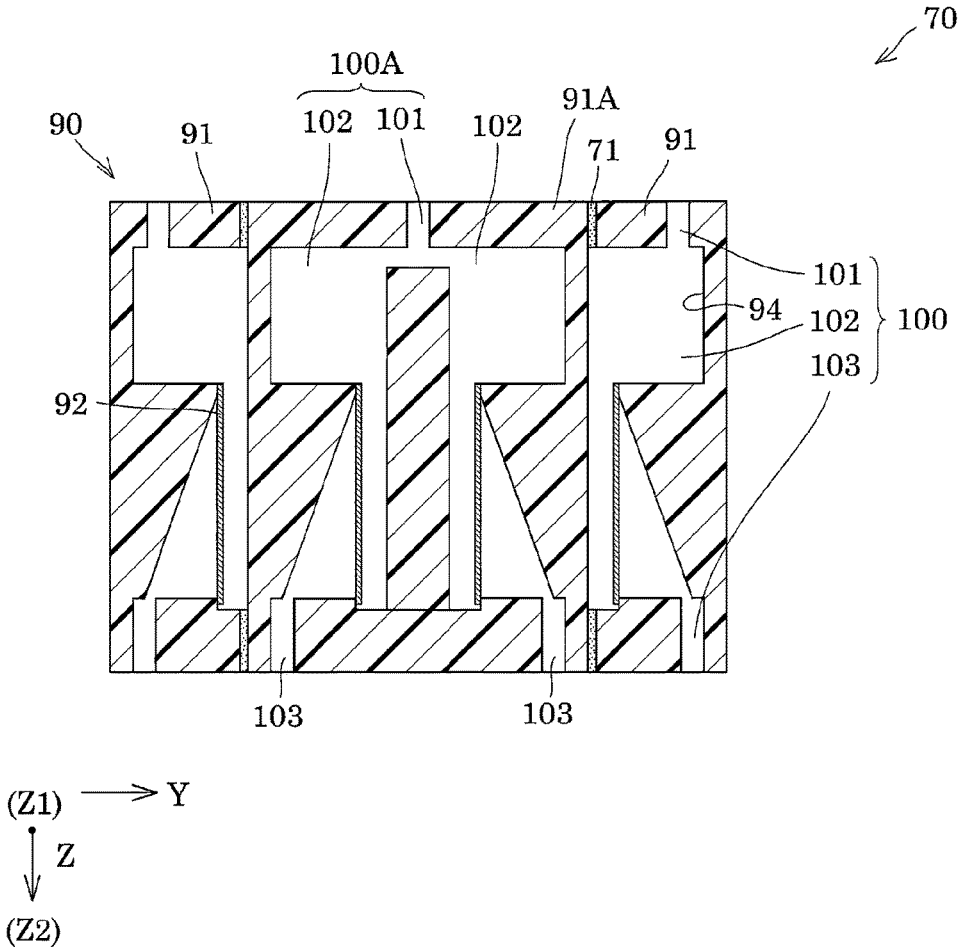
FIG. 9 is a cross-sectional view of a flow path member according to another embodiment of the invention.

As illustrated in FIG. 9, the flow path member 70 includes the filter unit main body 91A, and two filter unit main bodies 91 similar to the first embodiment described above.

The flow path 100A is disposed in the filter unit main body 91A. The flow path 100A includes a first flow path 101 branched into two in the middle, a filter chamber 102 communicating with each of the branched first flow paths 101, and a second flow path 103 communicating with each of the filter chambers 102. That is, the flow path 100A is branched into two in the middle from one inlet and has two outlets. In such a filter unit main body 91A, recessed portions 94 serving as filter chambers 102 are disposed on both sides in the second direction Y, and the openings of the two recessed portions 94 are sealed by the filter unit main body 91 of the first embodiment described above. In addition, in the filter unit main bodies 91 disposed on both sides of the filter unit main body 91A, the flow path 100 is formed with by sealing the recessed portions 94 with lid members 93 respectively disposed on the outside.

Even with such a configuration, similar to the first and second embodiments described above, it is possible to suppress the evaporation of the solvent of the ink in the flow path 100A of the filter unit main body 91. In addition, by using the filter unit main body 91A as compared with a case where the two filter unit main bodies 91 are adhered with the adhesive 71, it is possible to reduce the thickness in the second direction Y and to further reduce the size of the flow direction of the flow path member 70 in the second direction Y.

Furthermore, in each of the embodiments described above, although the flow path 100 for supplying the ink from the liquid storage means to the head main body is disposed in the filter unit 90, without being particularly limited thereto, for example, a flow path for recovering the ink from the head main body 10 to the liquid storage means, a waste liquid box or the like may be disposed, in addition to the flow path 100 to be supplied. As a matter of course, a recovery flow path unit having a flow path for recovering ink in the flow path member 70 may be disposed separately from the filter unit 90.

In addition, in each of the embodiments described above, although the evaporation of the solvent such as water contained in the ink is described, ink containing a solvent other than water may be used. That is, the flow path member 70 of each of the embodiments described above is used even for ink containing an organic solvent. Therefore, it is possible to suppress the evaporation of the solvent contained in the ink in the flow path 100 disposed in the filter units 90*b* and 90*c* or the filter unit main bodies 91*b* and 91*c*.

Figure 10:
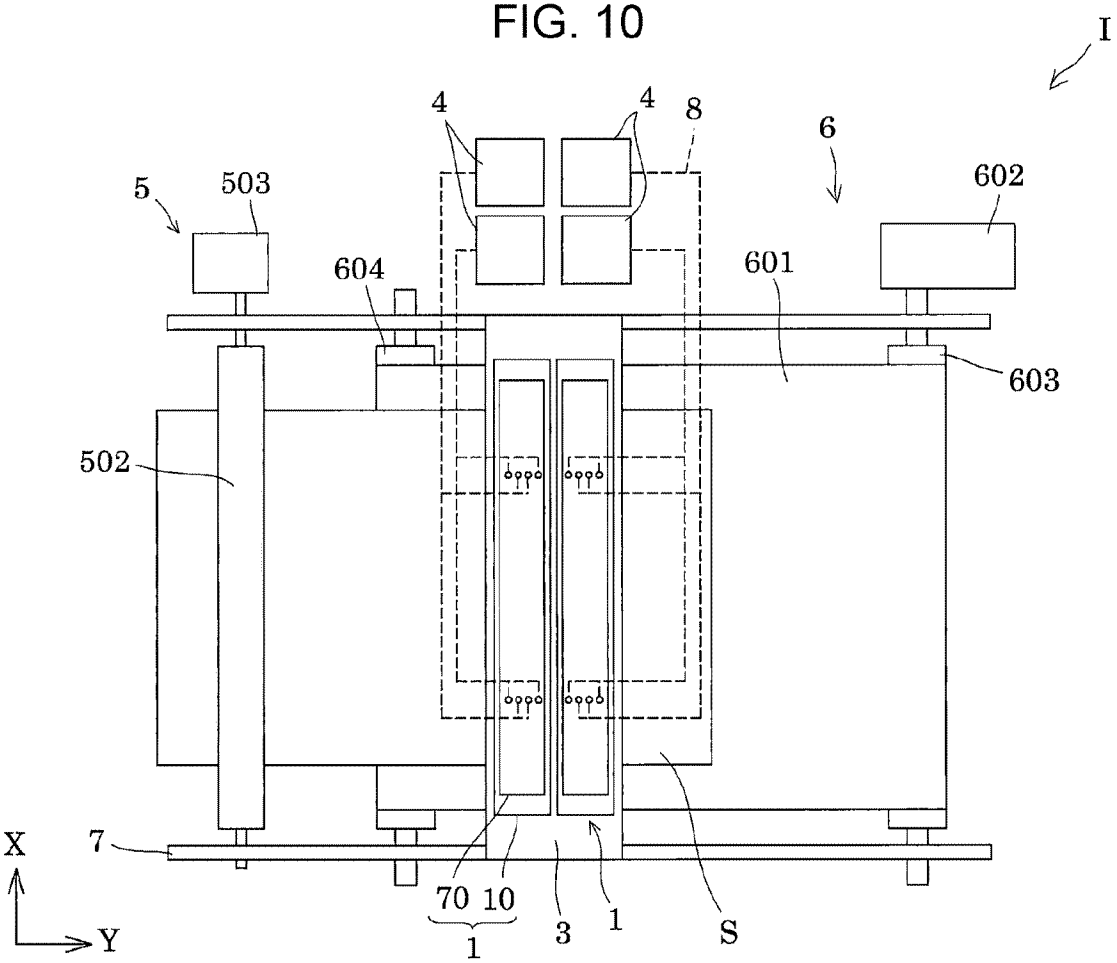
FIG. 10 is a plan view illustrating a schematic configuration of a recording apparatus according to one embodiment of the invention.
Figure 11:
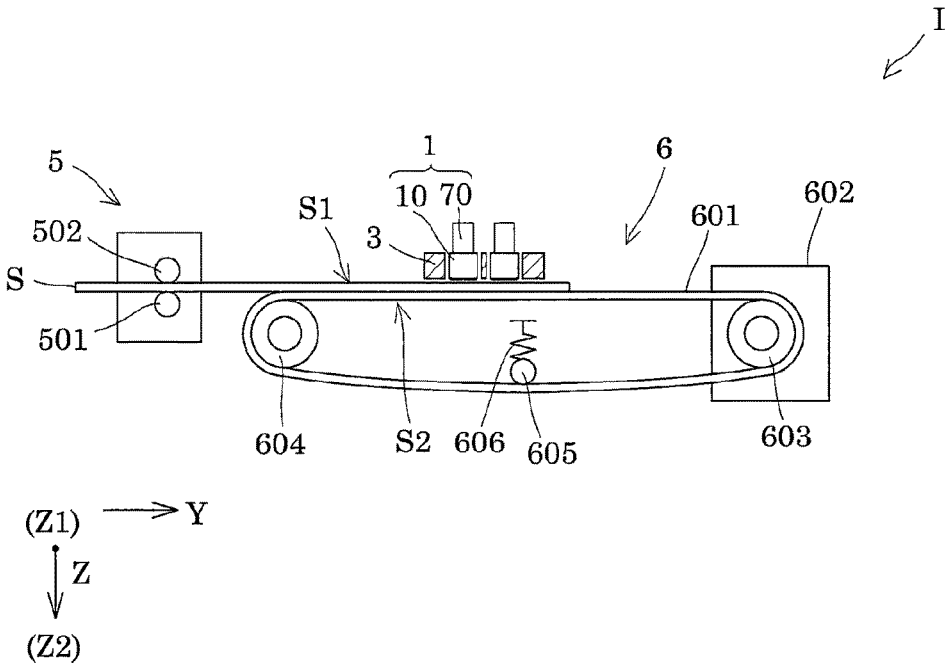
FIG. 11 is a side view illustrating a schematic configuration of the recording apparatus according to one embodiment of the invention.

The recording head 1 of each of the embodiments described above is mounted on an ink jet recording apparatus I. Here, the ink jet recording apparatus which is an example of a liquid ejecting apparatus of the embodiment will be described with reference to FIGS. 10 and 11. FIG. 10 is a plan view schematically illustrating an ink jet recording apparatus, and FIG. 11 is a side view of the ink jet recording apparatus.

The illustrated ink jet recording apparatus I of the embodiment is a so-called line type ink jet recording apparatus which performs the printing only by transporting a recording sheet S which is a medium to be ejected.

The ink jet recording apparatus I includes the plurality of recording heads 1, a base 3 on which the recording head 1 is mounted, liquid storage means 4 such as an ink tank in which the ink is stored, first transport means 5, second transport means 6, and an apparatus main body 7.

The recording head 1 is disposed so that the second direction Y is the transporting direction of the recording sheet S which is the medium to be ejected such as paper. In addition, in the embodiment, the base 3 holds two recording heads 1 arranged in parallel in the second direction Y. Thereby, the ink of four colors in total can be ejected from the two recording heads 1 over the width of the recording sheet S in the first direction X.

The liquid storage means 4 is for supplying the ink to the recording head 1, and is fixed to the apparatus main body 7 in the embodiment. The ink from the liquid storage means 4 fixed to the apparatus main body 7 is supplied to the recording head 1 via a supply pipe 8 such as a tube. The recording head 1 may be provided with the liquid storage means 4, for example, the liquid storage means 4 may be mounted on the Z1 side of the recording head 1 in the third direction Z.

The first transport means 5 is disposed on one side in the second direction Y of the recording head 1. The first transport means 5 includes a first transport roller 501, and a first driven roller 502 driven by the first transport roller 501. The first transport roller 501 is disposed on the side of a back surface S2 opposite to the landing surface S1 on which the ink of the recording sheet S lands, and is driven by driving force of the first driving motor 503. In addition, the first driven roller 502 is provided on the landing surface S1 side of the recording sheet S, and interposes the recording sheet S between the first driven roller 502 and the first transport roller 501. Such a first driven roller 502 presses the recording sheet S toward the first transport roller 501 side by a biasing member such as a spring (not illustrated).

The second transport means 6 includes a transport belt 601, a second driving motor 602, a second transport roller 603, a second driven roller 604, and a tension roller 605.

The second transport roller 603 is driven by the driving force of the second driving motor 602. The transport belt 601 is made of an endless belt and is hung around the outer circumference of the second transport roller 603 and the second driven roller 604. Such a transport belt 601 is disposed on the back surface S2 side of the recording sheet S. The tension roller 605 is disposed between the second transport roller 603 and the second driven roller 604, abuts against the inner peripheral surface of the transport belt 601, and applies a tension to the transport belt 601 by biasing force of the biasing member 606 such as a spring. Thereby, in the transport belt 601, the surface facing the recording head 1 is flat between the second transport roller 603 and the second driven roller 604.

In such an ink jet recording apparatus I, while transporting the recording sheet S in the second direction Y with respect to the recording head 1 by the first transport means 5 and the second transport means 6, the ink is ejected from the recording head 1 so that the ejected ink is landed on the landing surface S1 of the recording sheet S, that is, so-called printing is performed.

In the embodiment, although a so-called line type recording apparatus in which the recording head 1 is fixed to the apparatus main body 7 and the printing is performed only by transporting the recording sheet S is exemplified as the ink jet recording apparatus I, without being particularly limited thereto, for example, the invention can be applied to a so-called serial type recording apparatus, of which the recording head 1 is mounted on a carriage which moves in the first direction X which intersects the second direction Y which is the transport direction of the recording sheet S and the printing is performed while moving the recording head 1 in the first direction X.

In addition, in each of the embodiments described above, although the drive units 20 are arranged in a zigzag shape along the first direction X in the head main body 10, without being particularly limited thereto, the drive unit 20 may be arranged in parallel in the second direction Y, or the drive unit 20 may be arranged in parallel in a direction intersecting both of the first direction X and the second direction Y.

In addition, in each of the embodiments described above, although the recording head 1 including the flow path member 70 is described, the flow path member 70 may be disposed in a portion other than the recording head 1. Specifically, the flow path member 70 may be disposed, for example, in the middle of the liquid storage means 4 or the supply pipe 8.

Furthermore, the invention is directed to a manufacturing method for the whole liquid ejecting head in general, for example, and can also be applied to a manufacturing method for a recording head such as various ink jet recording heads used in an image recording apparatus such as a printer, a color material ejecting head used for manufacturing a color filter such as a liquid crystal display, an electrode material ejecting head used for forming an electrode of an organic EL display and a field emission display (FED), and a bioorganic material ejecting head used for manufacturing a bio chip.

In addition, the invention is not limited to the liquid ejecting head and the flow path member mounted on the liquid ejecting apparatus, and can be applied to a flow path member mounted on other devices.

The entire disclosure of Japanese Patent Application No. 2016-063252, filed Mar. 28, 2016 is expressly incorporated by reference herein.

What is claimed is:

1. A flow path member comprising:

a plurality of flow paths that include a first flow path, a filter chamber which communicates with the first flow path and is provided with a filter, and a second flow path which communicates with the filter chamber, wherein the plurality of flow paths are all disposed in a single housing of the flow path member, wherein the filter is disposed so that a direction of a flow of a liquid from either the first flow path or the second flow path is in a surface direction of the filter, wherein a plurality of filter chambers are disposed at positions where at least the plurality of filter chambers partially overlap each other in a normal direction with respect to the surface direction of the filter, wherein the plurality of filter chambers constitute a set of stacked filter chambers, the set of stacked filter chambers including outer filter chambers and one or more central filter chambers that are located in between the outer filter chambers, and wherein among the filter chambers of the plurality of flow paths, liquid with a large influence due to evaporation of a solvent contained in the liquid is supplied to at least one of the one or more central filter chambers as compared with the outer filter chambers.

2. The flow path member according to claim 1, wherein an amount of the solvent contained in the liquid supplied to the at least one of the one or more central filter chambers is smaller than an amount of solvent contained in a liquid supplied to the outer filter chambers.

3. The flow path member according to claim 1, wherein vapor pressure of the solvent contained in the liquid supplied to the at least one of the one or more central filter chambers is higher than vapor pressure of solvent contained in a liquid supplied to the outer filter chambers.

4. A flow path member comprising:

a plurality of flow paths that include a first flow path, a filter chamber which communicates with the first flow path and is provided with a filter, and a second flow path which communicates with the filter chamber, wherein the plurality of flow paths are all disposed in a single housing of the flow path member, wherein the filter is disposed so that a direction of a flow of a liquid from either the first flow path or the second flow path is in a surface direction of the filter, wherein a plurality of filter chambers are disposed at positions where at least the plurality of filter chambers partially overlap each other in a normal direction with respect to the surface direction of the filter, wherein the plurality of filter chambers constitute a set of stacked filter chambers, the set of stacked filter chambers including outer filter chambers and one or more central filter chambers that are located in between the outer filter chambers, and wherein among the filter chambers of the plurality of flow paths, liquid with a small amount of use per unit time is supplied to at least one of the one or more central filter chambers as compared with the outer filter chambers.

5. A liquid ejecting head comprising:

the path member according to claim 1; and a head main body that includes a nozzle which ejects liquid supplied from the flow path member.

6. A liquid ejecting head comprising:

the path member according to claim 2; and a head main body that includes a nozzle which ejects liquid supplied from the flow path member.

7. A liquid ejecting head comprising:

the path member according to claim 3; and a head main body that includes a nozzle which ejects liquid supplied from the flow path member.

8. A liquid ejecting head comprising:

the path member according to claim 4; and a head main body that includes a nozzle which ejects liquid supplied from the flow path member.

9. A liquid ejecting apparatus comprising the flow path member according to claim 1.

10. A liquid ejecting apparatus comprising the flow path member according to claim 4.

11. A flow path member comprising:

a plurality of flow paths that include a first flow path, a filter chamber which communicates with the first flow path and is provided with a filter, and a second flow path which communicates with the filter chamber, wherein the filter is disposed so that a direction of a flow of a liquid from either the first flow path or the second flow path is in a surface direction of the filter, and wherein a plurality of filter chambers are disposed at positions where at least the plurality of filter chambers partially overlap each other in a normal direction with respect to the surface direction of the filter, wherein the plurality of filter chambers constitute a set of stacked filter chambers, the set of stacked filter chambers including outer filter chambers and one or more central filter chambers that are located in between the outer filter chambers, wherein among the filter chambers of the plurality of flow paths, liquid with a large influence due to evaporation of a solvent contained in the liquid is supplied to at least one of the one or more central filter chambers as compared with the outer filter chambers.

12. A flow path member comprising:

a plurality of flow paths that include a first flow path, a filter chamber which communicates with the first flow path and is provided with a filter, and a second flow path which communicates with the filter chamber, wherein the filter is disposed so that a direction of a flow of a liquid from either the first flow path or the second flow path is in a surface direction of the filter, and wherein a plurality of filter chambers are disposed at positions where at least the plurality of filter chambers partially overlap each other in a normal direction with respect to the surface direction of the filter, wherein the plurality of filter chambers constitute a set of stacked filter chambers, the set of stacked filter chambers including outer filter chambers and one or more central filter chambers that are located in between the outer filter chambers, wherein among the filter chambers of the plurality of flow paths, liquid with a small amount of use per unit time is supplied to at least one of the one or more central filter chambers as compared with the outer filter chambers.

* * * * *